US005975387A

United States Patent [19]

Gleason et al.

[11] Patent Number: 5,975,387

[45] Date of Patent: Nov. 2, 1999

[54] BLADDER FRAME BACKPACK

[75] Inventors: Dana W. Gleason; Jesse B. Thompson, both of Bozeman, Mont.

[73] Assignee: K 2 Corporation, Vashon, Wash.

[21] Appl. No.: 08/893,530

[22] Filed: Jul. 11, 1997

[51] Int. Cl.[6] ..... A45F 3/04

[52] U.S. Cl. ..... 224/148.2; 224/148.3; 224/148.5; 224/644; 224/640; 224/641; 224/652

[58] Field of Search ..... 224/148.2, 148.3, 224/148.4, 653, 644, 148.5, 652, 640, 641; 222/175

[56] References Cited

U.S. PATENT DOCUMENTS

| | | | |
|---|---|---|---|
| 357,272 | 2/1887 | Donavin . | |
| 2,013,358 | 9/1935 | Osborne | 224/653 |
| 3,679,108 | 7/1972 | Ingram | 224/644 |
| 4,089,447 | 5/1978 | Achmeteli . | |
| 4,090,650 | 5/1978 | Gotta . | |
| 4,139,130 | 2/1979 | Glusker et al. . | |
| 4,189,075 | 2/1980 | Hall . | |
| 4,449,654 | 5/1984 | Cappis . | |
| 4,544,087 | 10/1985 | Modig . | |
| 4,852,781 | 8/1989 | Shurnick et al. . | |
| 5,060,833 | 10/1991 | Edison et al. | 224/148.2 |
| 5,104,016 | 4/1992 | Runkel . | |
| 5,400,934 | 3/1995 | Ducros | 224/148.2 |
| 5,427,290 | 6/1995 | Thatcher | 224/148.2 |
| 5,547,461 | 8/1996 | Levis | 224/644 |
| 5,573,166 | 11/1996 | Lesa | 224/644 |
| 5,601,221 | 2/1997 | Karr | 224/148.2 |

*Primary Examiner*—Linda J. Sholl
*Attorney, Agent, or Firm*—Darren J. Jones

[57] ABSTRACT

A pack for holding articles and providing fluid hydration is provided. The pack includes a bladder compartment having an opening for securing a fluid bladder therein for hydration with a hose attached thereto. The bladder has a front side adapted to be positioned against the user's back and a back side opposite the front side. The pack bag is sewn onto the back of the bladder compartment and is larger than the bladder compartment. The bladder compartment provides a cushion between the pack bag and the user and contours the back of the user. Shoulder straps are attached from the top of the bladder compartment to the bottom of the pack bag. A hip belt also extends from the bottom of the pack bag around the hips of the user. The top of the bladder compartment is at least partially separated from the top of the pack bag to allow the contouring of the bladder compartment along the upper portion of the back of the user. A lift strap extends between the top of the shoulder pad and the top of the pack bag. The bladder compartment also includes a side zipper extending substantially the length of the bladder compartment for removal of the bladder therefrom.

6 Claims, 2 Drawing Sheets

10
12
45
32
34
14
22
16
24
54
20
56
40
48
36
46
64
38
58
60
42
50
62
26
44
52

BLADDER FRAME BACKPACK

FIELD OF THE INVENTION

The present invention relates to packs for being carried on a user's back, and more particularly, to packs including liquid hydration systems.

BACKGROUND OF THE INVENTION

Active people find adequate hydration essential to achieving and sustaining high performance. To fulfill this need, hikers, bikers, skiers, snowshoers, skaters, and others have used water bottles carried on hip belts, on bike frames, or elsewhere. During these sports and other extreme sports, gripping ski poles, handlebars, etc. and maintaining momentum make it inconvenient to access and use a water bottle. Therefore, hydration bladders with hoses and bite valves have been used. The bladder may be placed within a conventional backpack or within its own specially constructed pack.

If a bladder, hose, and bite valve are used with a larger pack, the bladder (1) may be harmed by objects placed within the pack, (2) may not maintain a proper orientation for delivery of fluid, and/or (3) may have low pressure for poor fluid delivery. Furthermore, inherent advantages of the bladder are not realized when the bladder is simply placed within a larger pack.

If the bladder, hose, and bite valve are used with their own container, the container may be too small to carry extra necessary equipment. Furthermore, placing articles within the bladder container may damage the bladder or interrupt liquid delivery.

Therefore, a need exists for a hydration system integrally combined with a pack. The bladder can provide not only increased ease of hydration, but also pack comfort and stability.

SUMMARY OF THE INVENTION

The present invention provides a lightweight backpack with a hydration system that also functions as the pack frame. The hydration system is positioned between the user and the main compartment of the backpack to contour the back of the user and hold the backpack comfortably in place. The pack includes a bladder compartment and a pack bag. The bladder compartment has an opening for securing the fluid bladder therein. The fluid bladder may have a hose attached thereto for hydration delivery. The bladder has a front side adapted to be positioned against the user's back and a back side opposite the front side. The pack bag is attached to the back side of the bladder compartment. The pack bag has an opening for securing articles therein. The bladder compartment is disposed between the user and the pack bag to provide a cushion and framework for the pack bag while also providing fluid hydration.

In the preferred embodiment of the invention, the pack bag is larger than the bladder compartment. The pack bag extends outwardly beyond the width and height of the bladder compartment.

In one aspect of the invention, the bladder compartment includes a top end and a bottom end with shoulder straps attached to the top end. Furthermore, at least a portion of the top end of the bladder compartment is separated from the pack bag so as to contour the back of the user. Shoulder straps are attached at the top end to pull the bladder compartment to the user for a secure, comfortable load. Lift straps preferably attach at one end to the shoulder straps near the top end of the bladder compartment. The lift straps attach at their other ends to the pack bag. The lift straps help in providing load stabilization and weight transfer.

In one preferred aspect of the invention, a hip belt attaches to the pack bag near the bottom of the bladder compartment. The shoulder straps also include lower ends attached to the pack bag near the bottom of the bladder compartment.

In the preferred construction of the pack of the present invention, the pack bag includes a front panel attached directly to the back side of the bladder compartment. The attachment is such that a top end of the bladder compartment is at least partially separated from the pack bag so as to be able to flex forwardly relative to the pack bag. Preferably, the pack bag is sewn to the back side of the bladder compartment.

In another aspect of the preferred embodiment of the invention, the bladder compartment includes an insulation material layered therein and a zipper extending down a side thereof at least half the length of the bladder compartment.

The present invention may also include a frame wherein the frame includes the bladder compartment. The bladder compartment includes a front side adapted to sit against the back of the user and a back side opposite the front side, the bladder compartment thus providing the framework for the pack. The bag is attached to the back side of the bladder compartment and includes an opening for holding articles.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 2:
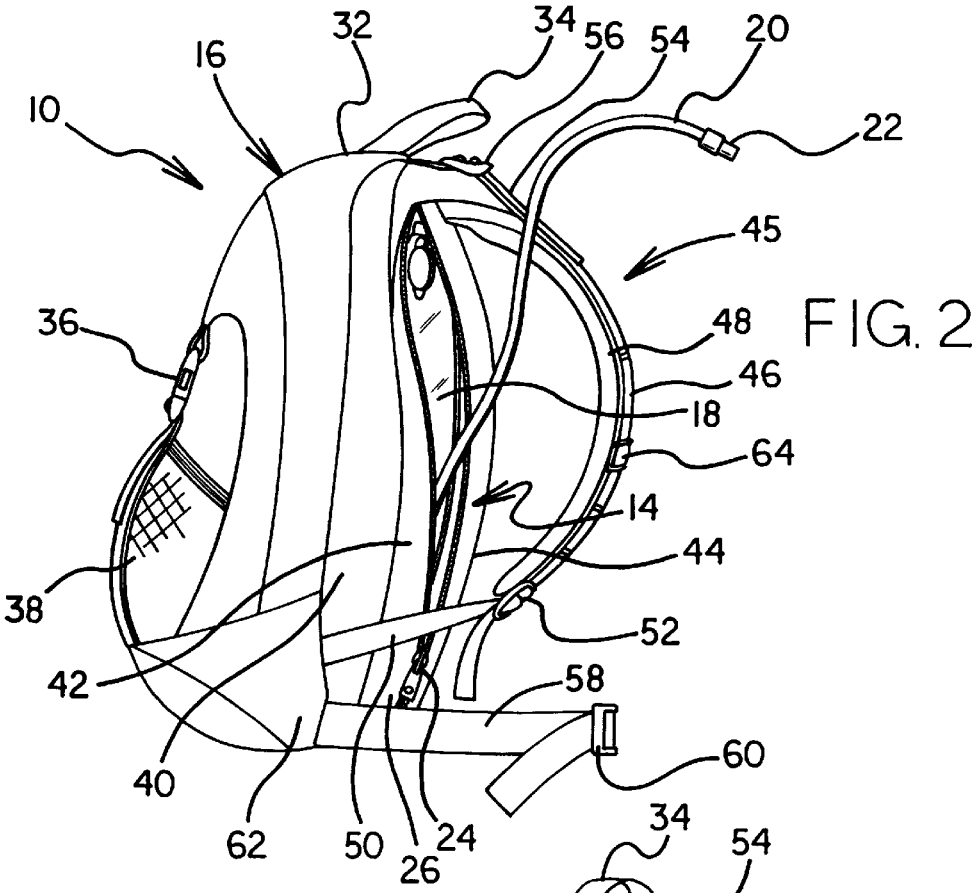
FIG. 2 is a side elevational view of the pack with the bladder compartment open.

The present invention includes a pack 10 for use on the back of a user 12. The basic elements of the pack include a bladder compartment 14 that rides against and contours the back of user 12 and a bag 16. Bladder compartment 14 is preferably a generally rectangular, hollow container, but may alternatively have other shapes to ride stable and secure on the user's back while carrying a bladder. Bag 16 is attached to the back of bladder compartment 14 as will be described in more detail below. Bag 16 generally sits apart from the back of user 12 due to bladder compartment 14 nesting between bag 16 and user 12. Thus, bladder compartment 14 provides the frame for pack 10 as it contours the back of the user and provides structure to hold bag 16. Bladder compartment 14 is also somewhat compliant and soft such that it flexes to the contours of the back of user 12 and comfortably rides thereon. Bag 16 may be used to carry various items therein, such as a bike helmet, skates, hiking gear, or other items. Bladder compartment 14 is used to carry a bladder 18 as shown in FIG. 2.

Bladder 18 may be filled with a fluid such as water or other liquid that may be used for hydration of user 12 while hiking or otherwise using pack 10. As illustrated in FIG. 2, bladder 18 is held within the opening in bladder compartment 14. A hose 20 is secured to the lower end of bladder 18 for delivery of liquid to the mouth of user 12. The end of hose 20 includes a bite valve 22 as with conventional hydration bladders. A Zipper 24 extends substantially the length of bladder compartment 14 for removal of bladder 18 when empty or for placement of bladder 18 after filling with fluid. Zipper 24 preferably extends along the side of bladder compartment 14 shifted toward the rear thereof, so as to not come in contact with the back of user 12.

Figure 3:
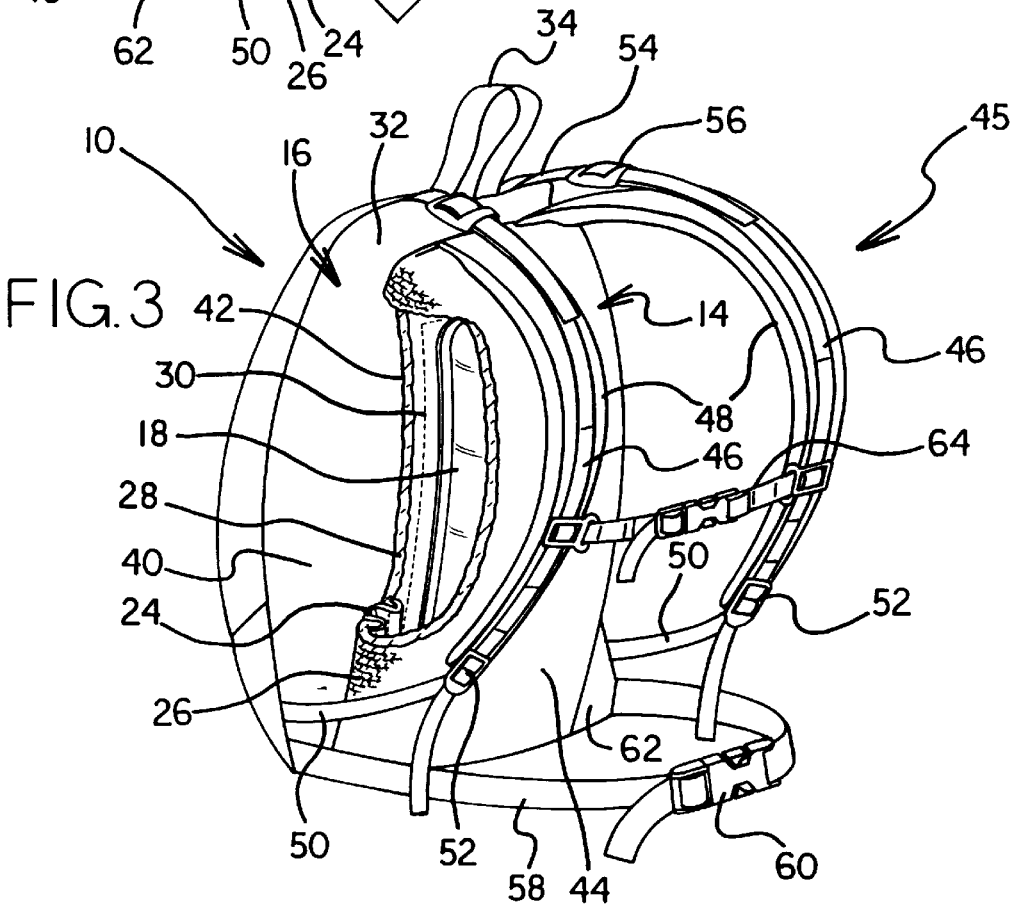
FIG. 3 is a perspective view of the pack with a partial cut-away of the bladder compartment.

As seen in FIG. 3, bladder compartment 14 includes a fabric cover 26. Fabric cover 26 may be constructed of a nylon material, Trico lining, or other soft, comfortable material. The material is preferably soft and flexible so as to be breathable and comfortable against the back of user 12. Alternatively, ribs may project from a front side 44 of bladder compartment 14 for additional air ventilation between the back of user 12 and front side 44 of bladder compartment 14. An insulation layer 28 is secured beneath fabric cover 26 to maintain the temperature of the liquid within bladder 18. Insulation layer 28 also functions as padding against the back of user 12. Insulation layer 28 is preferably constructed with an open-cell foam to allow air to flow therethrough for cooling the back of the user.

Figure 1:
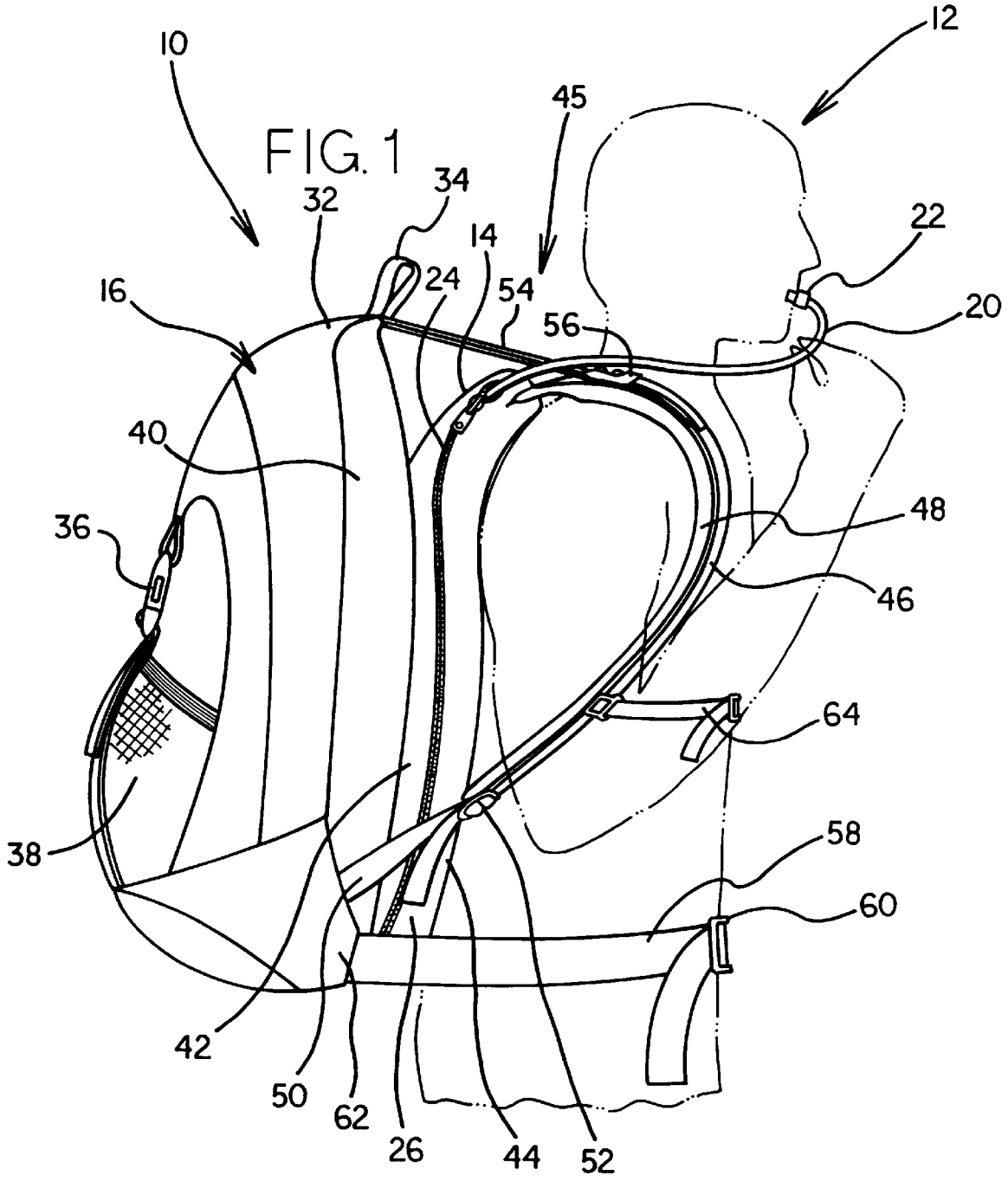
FIG. 1 is a side elevational view of the pack of the present invention shown on the back of the user.

Bladder compartment 14 is secured to a front panel 40 of bag 16 by stitching 30. Stitching 30 is preferably rectangular in shape extending through back side 42 of bladder compartment 14. Stitching 30 does not extend all the way to the outer sides (i.e., complete width and height) of bladder compartment 14, but is shifted inwardly. This allows bladder compartment 14 to expand or contract depending on how full bladder 18 is with fluid. Also, the uppermost reaches of stitching 30 are somewhat below the upper end of bladder compartment 14. This allows the top of bladder compartment 14 to curve around the back of user 12 as illustrated in FIG. 1 without pulling bag 16 necessarily around the back of user 12. Thus, rigid articles such as books, shovels, or other items may be carried within bag 16 and project upwardly while bladder compartment 14 provides the framework that curves around the back of the user toward the neck of the user. In this way, bladder compartment 14 provides a framework that moves with user 12 and securely holds pack 10 no matter what unusual load may be held within bag 16.

Bag 16 includes an upper end 32 preferably somewhat separated from the upper end of bladder compartment 14. Upper end 32 includes a carrying strap 34 stitched into the top thereof for hand-carrying pack 10 when not on the back of user 12. Bag 16 may have any number of configurations depending on the intended use thereof The bag illustrated in this preferred embodiment includes a buckle 36 with an outer compartment 38 to carry such items as a jacket or bicycle helmet outside the main compartment of bag 16. Bag 16 includes a front panel 40 that is stitched to back side 42 of bladder compartment 14 as discussed above. Front panel 40 is preferably wider and taller than bladder compartment 14 and back side 42 of bladder compartment 14. Thus, large loads may be carried within bag 16 while bladder compartment 14 provides the framework for securing bag 16 to user 12. Alternatively, bag 16 could be somewhat smaller than the preferred bag 16 illustrated and described herein. Bladder compartment 14 may vary in size depending on the intended use of pack 10. For example, smaller packs may be used for short bicycle rides, hikes, or skating trips.

A harness 45 is provided for securing pack 10 to the back of user 12. Harness 45 includes a shoulder strap 46 secured to the top of bladder compartment 14. A lower strap 50 is secured to the bottom of bag 16 and attached with an adjustment buckle 52 to shoulder strap 46. In the preferred embodiment, shoulder strap 46 also includes a shoulder pad so that heavy loads may comfortably rest on the shoulders of user 12. The attachment of shoulder strap 46 to the top of bladder compartment 14 aids in curving bladder compartment 14 around the back of the user for comfortable and secure riding of pack 10. As mentioned above, upper end 32 of bag 16 preferably is not secured to the upper end of bladder compartment 14. A lift strap 54 is secured between upper end 32 and shoulder strap 46 to pull the load within bag 16 as desired for weight distribution and compression of bag 16 for a stable, secure, and comfortable load on user 12. Lift strap 54 includes a lift strap buckle 56 for adjustment thereof.

Harness 45 also includes a hip belt 58 with a belt buckle 60. Hip belt 58, in the preferred embodiment, secures to the lower end of bag 16 with belt wings 62 projecting forwardly from the main compartment of bag 16. The construction of the hip belt will be apparent to those skilled in the art. Hip belt 58 helps to stabilize the load within bag 16, as well as bladder compartment 14, and also aids in compressing bladder compartment 14 to introduce a positive pressure within bladder 18 for easier delivery of fluid through hose 20. A sternum strap 64 is also provided with harness 45 preferably in a conventional configuration between shoulder straps 46.

The complete pack arrangement, bladder compartment 14, bag 16, and harness 45, creates a comfortable and stabile combined pack and hydration system for hiking, biking, skating, or other such activities. The bladder's conformance to the back of the user provides improved stability so that the load stays put and rides well with superior comfort.

While the preferred embodiment of the invention has been illustrated and described, it will be appreciated that various changes can be made therein without departing from the spirit and scope of the invention.

The embodiment of the invention in which an exclusive property or privilege is claimed is defined as follows:

1. A pack for a user comprising:

(a) a bladder compartment having an opening for securing a fluid bladder therein for hydration with a hose attached thereto, said bladder compartment having a front side adapted to be positioned against the user's back and a back side opposite the front side, wherein said bladder compartment includes a top end and a bottom end, the pack further comprising shoulder straps attached to the top end of the bladder compartment;

(b) a pack bag attached to the back side of said bladder compartment, said pack bag having an opening for securing articles therein; wherein said bladder compartment is disposed between the user and the pack bag to provide a cushion and framework for the pack bag while also providing fluid hydration; said pack bag being larger than said bladder compartment, said bladder compartment having a width and a height, said pack bag extending outwardly beyond the width and height of the bladder compartment; wherein at least a portion of the top end of the bladder compartment is separated from the pack bag so as to be able to contour the back of the user as pulled by the shoulder straps.

2. The pack of claim 1, further comprising lift straps attached at one end to the shoulder straps near the top end of the bladder compartment and at the other end to the pack bag for load stabilization and weight transfer.

3. A pack for a user comprising:

(a) a bladder compartment having an opening for securing a fluid bladder therein for hydration with a hose attached thereto, said bladder compartment having a front side adapted to be positioned against the user's back and a back side opposite the front side; and (b) a pack bag attached to the back side of said bladder compartment, said pack bag having an opening for securing articles therein wherein said bladder compartment is disposed between the user and the pack bag to provide a cushion and framework for the pack bag while also providing fluid hydration, said pack bag being larger than said bladder compartment, said bladder compartment having a width and a height, said pack bag extending outwardly beyond the width and height of the bladder compartment, wherein said pack bag includes a front panel attached directly to the back side of said bladder compartment, wherein said bladder compartment includes a top end at least partially separated from said pack bag so as to be able to flex forwardly relative to said pack bag.

4. The pack of claim 3, wherein said front panel of said pack bag is attached to the back side of said bladder compartment by a sewn engagement.

5. The pack of claim 4, wherein said bladder compartment includes an insulation material.

6. A pack to be worn on the back of a user comprising:

(a) a frame, said frame including a bladder compartment having a front side adapted to be placed against the back of the user and a back side opposite the front side, wherein said bladder compartment includes an upper end and a lower end;

(b) a bag attached to the back side of said bladder compartment, said bag having an opening for holding articles;

(c) the pack further comprising shoulder straps having upper ends attached to the upper end of the bladder compartment, wherein at least a portion of the upper end of said bladder compartment is separated from said bag and wherein said bag extends above the upper end of said bladder compartment.

* * * * *